US005950760A

United States Patent [19]

Morrison

[11] Patent Number: 5,950,760

[45] Date of Patent: Sep. 14, 1999

[54] SCAFFOLDING SYSTEM FOR USE ON AN INCLINED SURFACE

[76] Inventor: Stephen Morrison, 1801 Alexander Ave., Tacoma, Wash. 98421

[21] Appl. No.: 08/708,583

[22] Filed: Sep. 5, 1996

[51] Int. Cl.[6] ..... E04G 3/00

[52] U.S. Cl. ..... 182/82; 182/87; 182/148

[58] Field of Search ..... 182/45, 82, 148, 182/229, 87

[56] References Cited

U.S. PATENT DOCUMENTS

| | | | |
|---|---|---|---|
| 786,054 | 3/1905 | Roy | 182/82 X |
| 2,329,415 | 9/1943 | Osborne | 182/45 X |
| 3,058,542 | 10/1962 | Rogalla | 182/45 |
| 3,164,353 | 1/1965 | Rene | 182/82 X |
| 3,679,026 | 7/1972 | Hansen et al. | 182/82 X |
| 4,078,633 | 3/1978 | Fahy | 182/45 X |
| 4,382,488 | 5/1983 | Anderson . | |
| 4,392,550 | 7/1983 | Bergeron | 182/82 |
| 4,421,205 | 12/1983 | Vranish et al. | 182/82 |
| 4,432,435 | 2/1984 | Anderson . | |
| 4,446,945 | 5/1984 | Anderson . | |
| 4,499,967 | 2/1985 | Anderson . | |
| 4,516,661 | 5/1985 | Stafford | 182/82 |
| 4,597,471 | 7/1986 | Anderson . | |
| 4,598,794 | 7/1986 | Anderson . | |
| 4,676,341 | 6/1987 | Shaffstall | 182/45 |
| 4,826,122 | 5/1989 | Cupp | 182/82 X |
| 4,944,365 | 7/1990 | Shalders | 182/82 X |
| 5,067,586 | 11/1991 | Myers | 182/82 X |
| 5,211,125 | 5/1993 | Garland et al. . | |
| 5,249,397 | 10/1993 | Monaco | 182/45 X |
| 5,307,899 | 5/1994 | Lubinski | 182/82 X |
| 5,570,559 | 11/1996 | Lewis | 182/45 X |

FOREIGN PATENT DOCUMENTS

| | | |
|---|---|---|
| 1466419 | 3/1977 | United Kingdom . |
| 1533165 | 11/1978 | United Kingdom . |
| WO 85/02642 | 6/1985 | WIPO . |

*Primary Examiner*—Daniel P. Stodola
*Assistant Examiner*—Richard M. Smith
*Attorney, Agent, or Firm*—Sterne, Kessler, Goldstein & Fox, P.L.L.C.

[57] ABSTRACT

A scaffolding system for use on an inclined surface, such as inside a ship cargo hold. The scaffolding system includes a scaffold pole and a support bracket that secures the scaffold pole to a support surface. The support bracket is only in place temporarily and is removed once the work is finished. A swivel foot is coupled to the scaffold pole. The swivel foot is configured to pivotally align with the inclined surface. A preventer is attached to the scaffold pole, and uses the support surface to prevent the scaffold pole from sliding along the inclined surface, and to provide additional lateral support.

20 Claims, 8 Drawing Sheets

SCAFFOLDING SYSTEM FOR USE ON AN INCLINED SURFACE

BACKGROUND OF THE INVENTION

1. Field of the Invention

This invention relates to a scaffolding system for use on an inclined surface, such as inside a ship cargo hold.

2. Description of Related Art

A large segment of the maritime transport business involves the bulk shipment of cargoes in motor vessels with open top holds. These cargoes range from edible products such as wheat, soya, corn, etc. to the inedible, such as iron ore, coal, fertilizer, chemicals etc. The holds range in depth from 30 to over 75 feet. Because of the limited number of vessels available to carry bulk cargoes, a ship may carry coal on one voyage and grain on the next. However, before a ship can load grain at any grain elevator in the United States, its holds must be inspected for cleanliness by representatives of the U.S. Department of Agriculture and the National Cargo Bureau. If contaminants, such as rust, paint scale or residue from the previous cargo are found, the ship must be cleaned before it will be allowed to proceed to berth and load its cargo.

While a vessel is being cleaned, it is not ready to load cargo. A day when a vessel is not ready to load cargo is referred to as a "lay day." Each lay day represents revenue lost to the vessel owners and operators. The cleaning of the ship incurs significant additional cost. Cleaning a seven-hold ship in the manner required to pass cargo loading inspections can require three lay days, and cost of more than $80,000. Vessel owners and operators have tried to cut these costs by using the ship's crew to clean the holds while the ship is in transit to the grain elevator. However, the only equipment conventionally available to the crew for reaching the higher areas in the cargo holds are ladders. Because of the pitching and rolling of the ship as it passes through open seas, only short ladders can be safely used. Additionally, once in port, and having failed the inspection, the crews often have neither the time nor the equipment to quickly and efficiently correct the inspection discrepancies. As a result, shore cleaners are called in to do the required cleaning.

The use of conventional scaffolding within a ship hold while the ship is in transit is impractical for the following reasons. Conventional scaffolding must rest on a flat surface. With the pitching of the deck, conventional scaffolding becomes unstable. Because conventional scaffolding must rest on a flat surface, it is prevented by the "hoppers" from getting close to the bulkheads. Conventional scaffolding is made from steel, and, consequently, is heavy. Several classes of ship have no deck gear for lowering equipment into the cargo holds. For such classes of ship it is difficult, if not impossible, to use conventional steel scaffolding for cleaning the cargo holds. Additionally, conventional steel scaffolding covers only ten (10) lineal feet of area to be cleaned per set-up. Each set-up takes approximately four hours. At such a rate there is not enough transit time to complete the cleaning for a typical cargo ship. Consequently, the use of conventional scaffolding is an impractical option for cleaning cargo holds while the ship is in transit.

A scaffolding system that takes less time to erect is described in U.S. Pat. No. 4,598,794 to Anderson. The Anderson patent describes a pump jack scaffolding system, employing pump jacks and pump jack poles. Workers stand on scaffolding staging, which is supported by support arms that project from the pump jacks, and operate the pump jacks to move the staging up and down along the pump jack poles.

The scaffolding described in the Anderson patent is erected more simply and quickly than conventional scaffolding. However, the scaffolding system described in the Anderson patent is inoperable in an environment having an inclined or sloping surface, such as a cargo hold of a ship. Additionally, the scaffolding system described in the Anderson patent is not configured for a moving environment, such as when a ship is at sea. The scaffolding system of the Anderson patent does not provide the support needed to stabilize the scaffolding system against the movement of the ship.

Thus, there is a need for a scaffolding system that can be used on an inclined surface and in a moving environment. There is a need for a scaffolding system that enables ship crews to safely and efficiently clean cargo holds while underway.

SUMMARY OF THE INVENTION

The scaffolding system of the present invention is configured for use on an inclined surface and in a moving environment, such as the cargo hold of a ship. The scaffolding system of the present invention includes a scaffold pole and a support bracket for securing the scaffold pole to a support surface. A swivel foot is coupled to the scaffold pole. The swivel foot is configured to pivotally align with the inclined surface. A preventing means is used for preventing the scaffold pole from sliding along the inclined surface. The scaffolding system can be configured with a pump jack adapted to travel along (e.g., up and down) the scaffold pole. A walking plank can be coupled to the pump jack. The pump jack allows a worker to adjust the walking plank to the desired height.

In one aspect of the present invention, the preventing means includes a bolt coupled to the scaffold pole, and a securing line having a first end connected to the bolt. A second end of the securing line is connected to the support surface.

In another aspect of the present invention, both ends of the securing line of the preventing means are connected to the scaffold pole. In such a configuration, the securing line loops through an open space or region in the support surface.

In yet a further aspect of the invention, the scaffolding system includes a swivel foot connecting means for connecting the swivel foot to the scaffold pole. The swivel foot connecting means includes a first tube and a second tube. The two tubes are configured so that the first tube is slidably received within the second tube. The first tube can be round in cross-section and the second tube can have a square outer surface.

Features and Advantages

It is a feature of the present invention that it includes a preventing means that prevents the scaffold pole from sliding along an inclined or sloping surface. The preventing means also provides additional lateral support for the scaffold pole.

It is a further feature of the present invention that it is stabilized by bolting or clamping a support bracket to a support surface. It is an advantage of the present invention that the support bracket is only in place temporarily, and is removed once the work is finished.

It is an advantage of the present invention that it is perfectly adapted to maritime industry needs in that it is extremely light and portable while being extremely stable when fully erected. The present invention can be easily erected by as few as one person for use on an inclined or sloping surface, and in a moving environment. A further advantage of the present invention is that is provides an access swath of as much as 24 feet wide, and 50 feet high.

A further advantage of the present invention is that it is height adjustable to enable a ship's crew to safely clean all vertical surfaces.

It is yet a further advantage of the present invention that the fatigue factor associated with cleaning of a cargo hold (precipitated by mounting a ladder, working from a rung on the ladder, and then dismounting from the ladder) is essentially eliminated because the ship's crew is working from a 24 foot walking plank rather than from a 2 foot ladder rung.

A still further advantage of the present invention is that it allows a ship's crew to perform maintenance in the areas of ship holds that are inaccessible using conventional equipment.

It is yet a further advantage of the present invention that it saves time and money. Because a ship's crew can effectively and safely clean the holds while the ship is in transit, the time and money conventionally lost to lay day delays and hold cleaning operations performed by shore cleaners are eliminated.

BRIEF DESCRIPTION OF THE FIGURES

The accompanying drawings, which are incorporated in and form a part of the specification, illustrate the present invention and, together with the description, serve to explain the principles of the invention. An embodiment of the present invention will be described in accordance with the drawing figures in which similar reference numbers are used to describe similar elements. In the drawings.

DETAILED DESCRIPTION OF THE PREFERRED EMBODIMENTS

The scaffolding system of the present invention can be used on an inclined or sloping surface and in a moving environment, such as aboard in-transit motor vessels on the open ocean. The scaffolding system is stabilized by bolting or clamping support brackets on each scaffold pole to a support surface. The support brackets are only in place temporarily and are removed once the work is finished. A swivel foot is coupled to each scaffold pole. The swivel foot pivotally aligns with the inclined surface. A preventing means is used for preventing the scaffold pole from sliding along the inclined surface. The preventing means is attached to the scaffold pole. The preventing means can be attached directly to the support surface. Alternatively, the preventing means can be looped through an open space or region in the support surface. In addition to preventing the scaffold pole from sliding along the inclined surface, the preventing means provides additional lateral support.

Figure 1A:
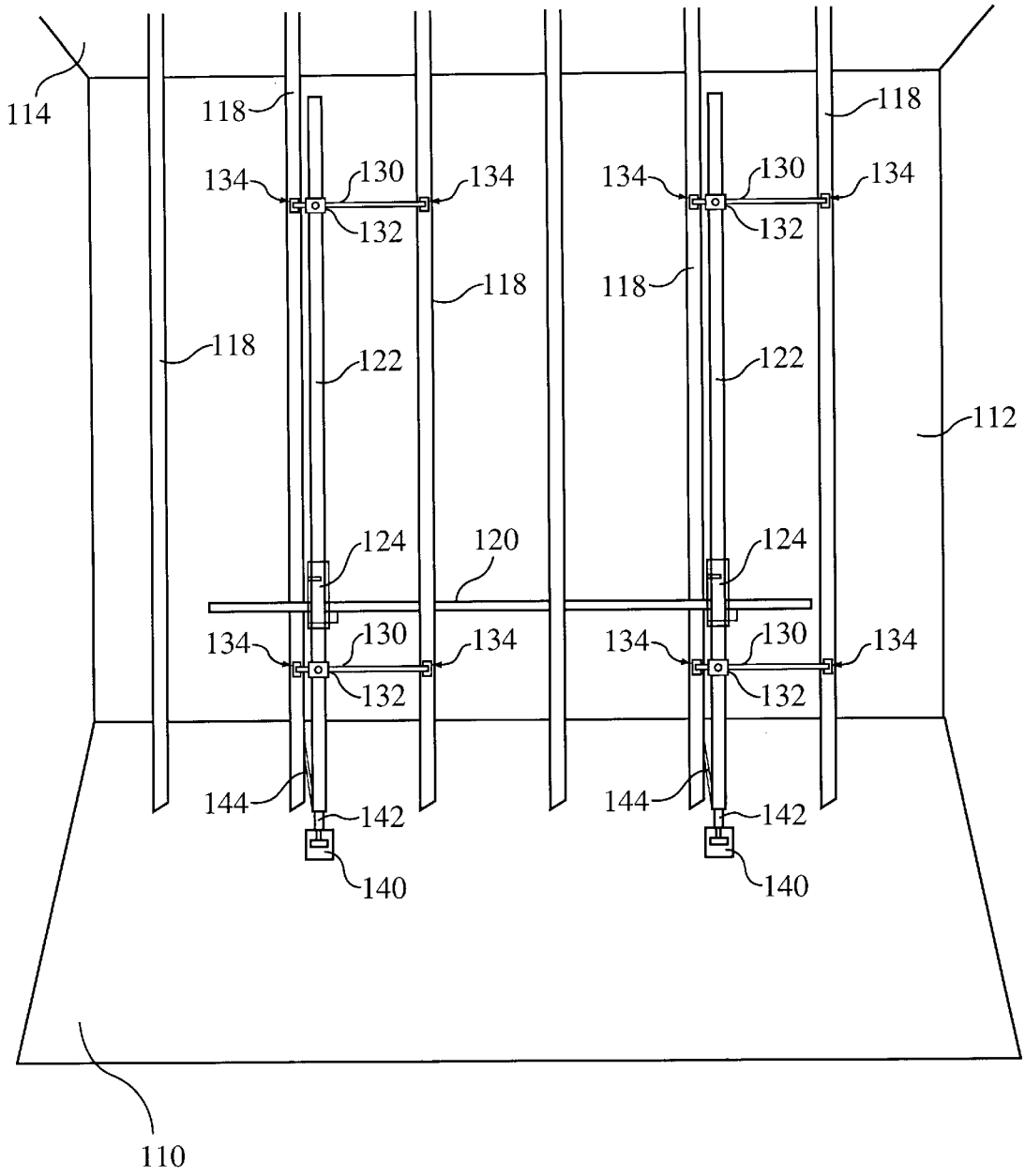
FIG. 1A is a front elevational view of an embodiment of the present invention.
Figure 1B:
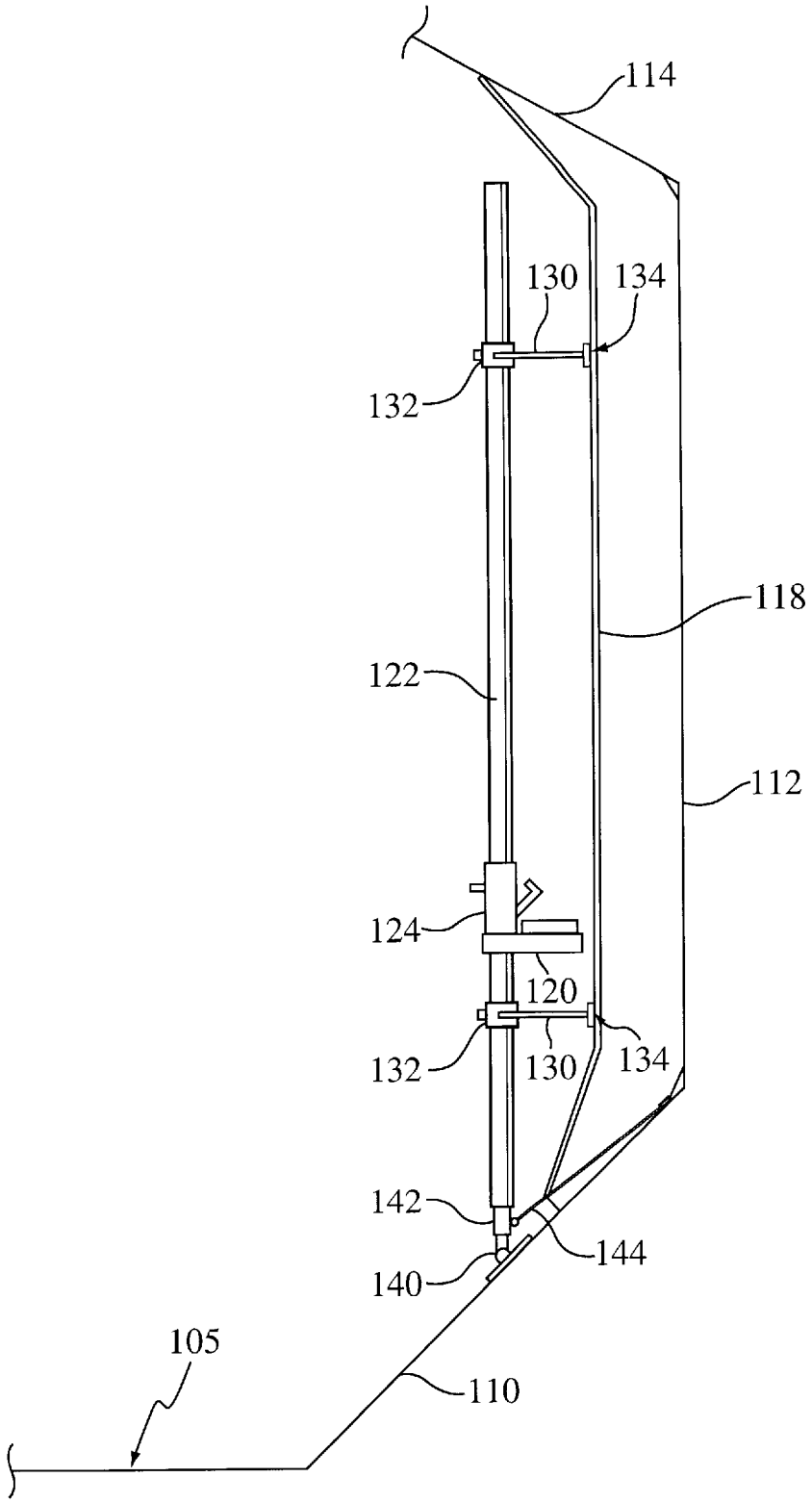
FIG. 1B is a side elevational view of an embodiment of the present invention.

With reference now to the figures, FIG. 1A and FIG. 1B show elevational views of a scaffolding system for use on an inclined or sloping surface. The scaffolding system is used with a support surface. In the illustrated embodiment, the inclined surface is a downsloping hopper wall 110 within a cargo hold of a ship with the tank top shown generally at 105. In order to clean bulkhead 112, support ribs 118, and upsloping wing tank 114, a scaffolding system of the present invention can be erected.

As shown, the scaffolding system includes two scaffolding support structures, spaced apart from each other, on which a walking plank 120 is placed. Each support structure includes a scaffold pole 122 and a pump jack 124. Pump jack 124 is adapted to travel along (e.g., up and down) scaffold pole 122. In a preferred embodiment, scaffold pole 122 is formed of an elongated vertical metal pole having a rubberized surface formed on only one side of the metal pole. A preferred embodiment of scaffold pole 122 is disclosed in U.S. Pat. No. 4,598,794, the entirety of which is incorporated herein by reference. Walking plank 120 is coupled to pump jack 124 in a well known manner. Pump jack 124 can be of any standard pump jack configuration. Such pump jack configurations are known to one of skill in the relevant art for use in ascending and descending along scaffold poles. A preferred embodiment of pump jack 124 is also disclosed in U.S. Pat. No. 4,598,794, the entirety of which has been incorporated herein by reference. Walking plank 120 can be of any standard scaffolding staging, such as is well known in the art for use in supporting the weight of a worker. A preferred embodiment of walking plank 120 is also disclosed in U.S. Pat. No. 4,598,794.

A swivel foot 140, to be described below, is attached at the bottom of scaffold pole 122 to pivotally align with the inclined surface of downsloping hopper wall 110. Swivel foot 140 provides a base for scaffold pole 122. Swivel foot 140 is connected to scaffold pole 122 through the use of a foot connector 142, to be described below.

A support bracket 130 is attached to scaffold pole 122 by a bracket connector 132. Support bracket 130 is attached to steel support ribs 118 by a bracket hold 134 to steady and secure scaffold pole 122. Support bracket 130 provides lateral support for the scaffolding system of the present invention. In the illustrated embodiment, the lateral support is provided by connecting support bracket 130 to ship's structure (steel support ribs 118). Additional lateral support for scaffold pole 122 is provided by preventer 144, to be described below.

Figure 2A:
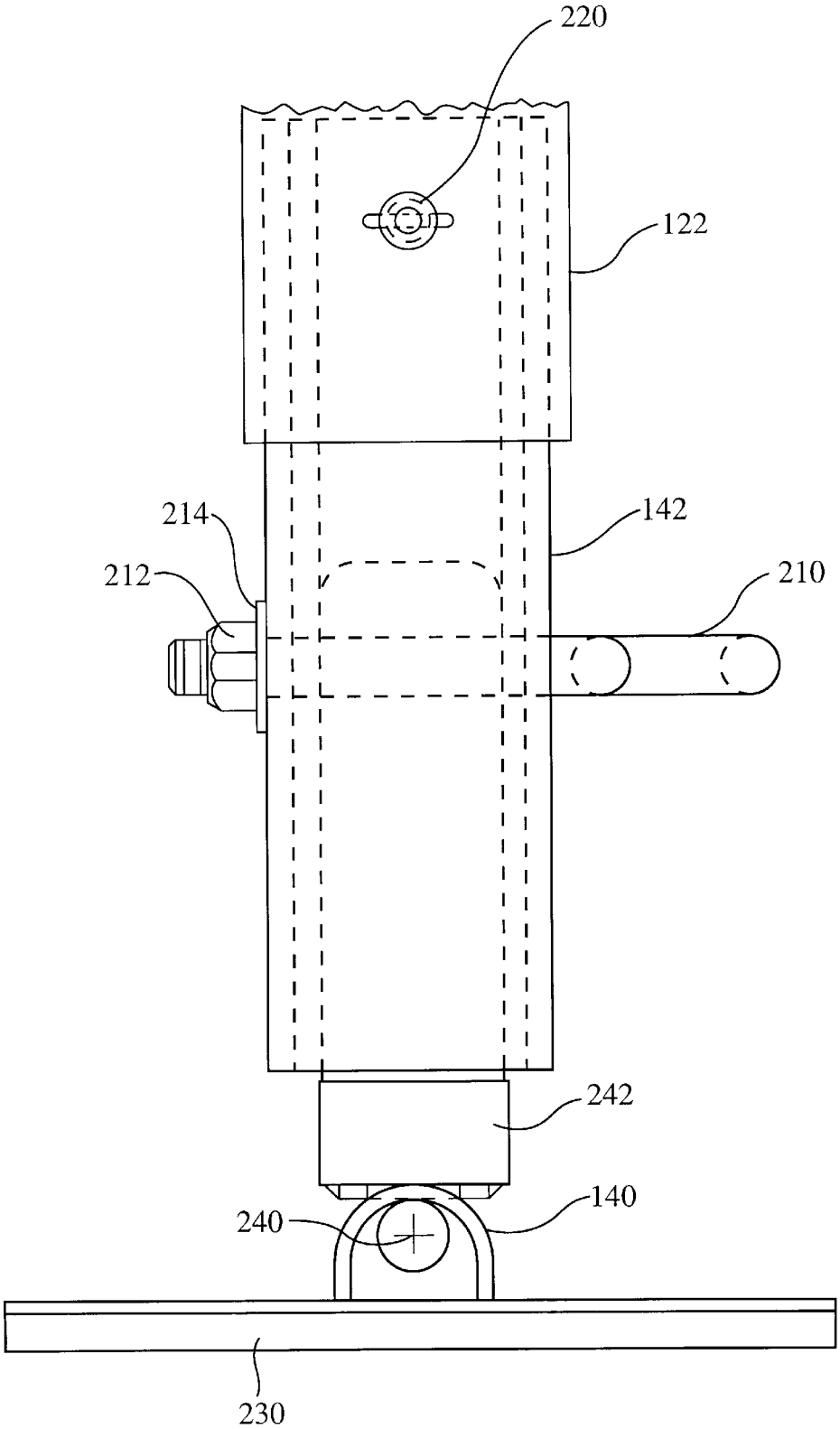
FIGS. 2A and 2B are partial elevational views of an embodiment of the present invention showing a swivel foot and a swivel foot connector.
Figure 2B:
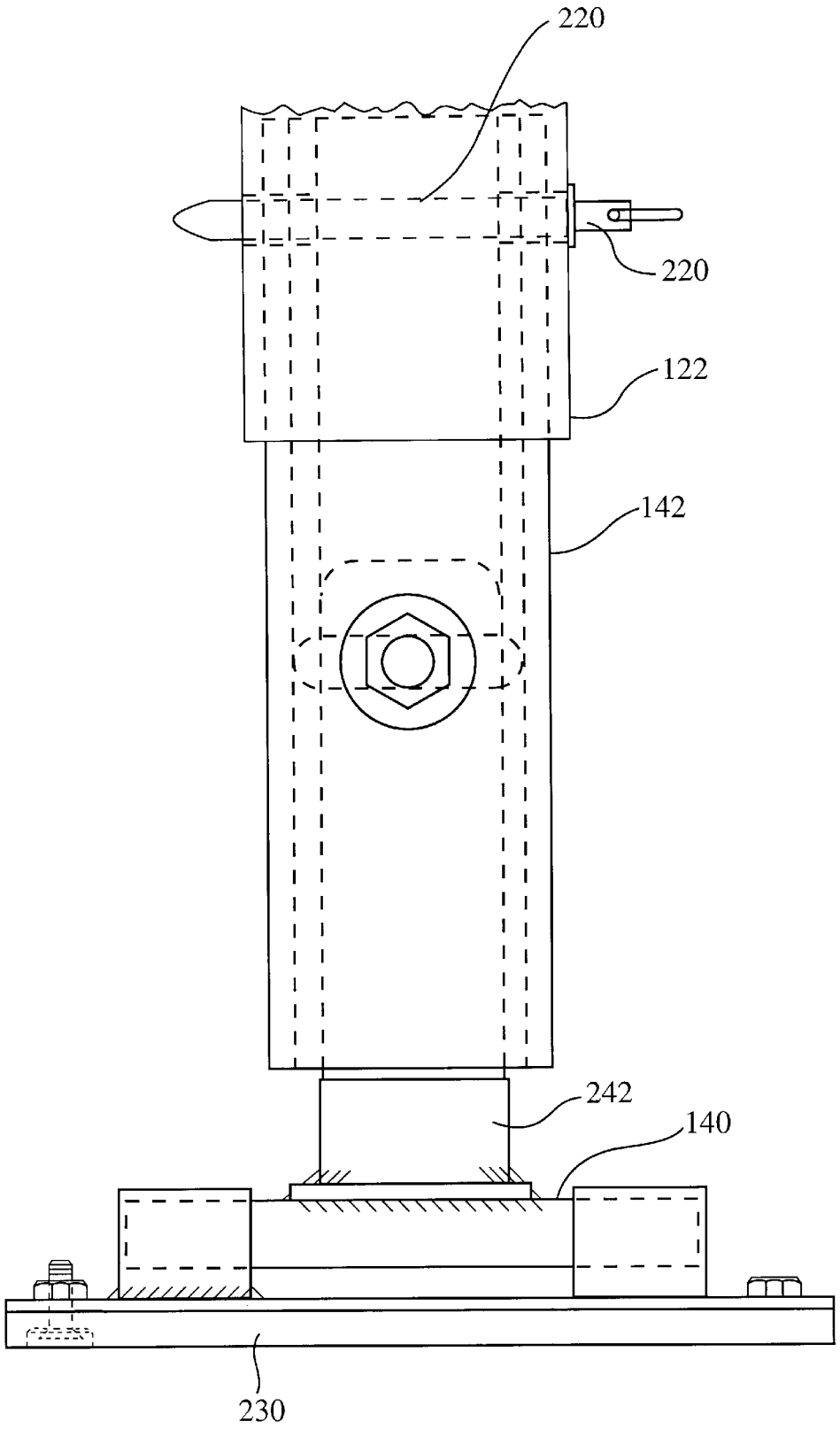

FIG. 2A and FIG. 2B show partial elevational views of a scaffolding system for use on an inclined surface, focusing on swivel foot 140. Swivel foot 140 is attached to scaffold pole 122 by way of foot connector 142. Swivel foot 140 is attached to a leg 242 at pivot point 240. Such a configuration allows swivel foot 140 to pivotally align with an inclined or sloping surface, such as downsloping hopper wall 110.

In the illustrated embodiment, leg 242 forms a tube that is round in cross-section. Scaffold pole 122 is square in cross-section. Foot connector 142 allows round leg 242 to be connected to square scaffold pole 122. In one embodiment, foot connector 142 is configured by inserting a tube round in cross-section into a square tube to form an adaptor that has a square outer surface for mating with scaffold pole 122 and a round inner surface for mating with leg 242. Such a configuration allows leg 242 to be inserted into, and slidably received within, foot connector 142. Means are used for securing foot connector 142 and leg 242 to each other. In the illustrated embodiment, the means for securing comprises an eyebolt 210 passed through foot connector 142 and leg 242 to secure leg 242 to foot connector 142. A nut 212 and a washer 214 are placed at one end of eyebolt 210 to further lock leg 242 in place within foot connector 142.

A hitch pin 220 is passed through scaffold pole 122 and foot connector 142 to secure foot connector 142 to scaffold pole 122. Through the use of foot connector 142 and leg 242, swivel foot 140 is secured to an end of scaffold pole 122 to provide a pivotal base for scaffold pole 122 which can align with an inclined surface. A rubber pad 230 is disposed on a bottom surface of swivel foot 140 so that rubber pad 230 contacts the inclined surface. Rubber pad 230 is preferably ½ inch thick. The purpose of rubber pad 230 is to improve the coefficient of friction between swivel foot 140 and the inclined surface.

Figure 5:
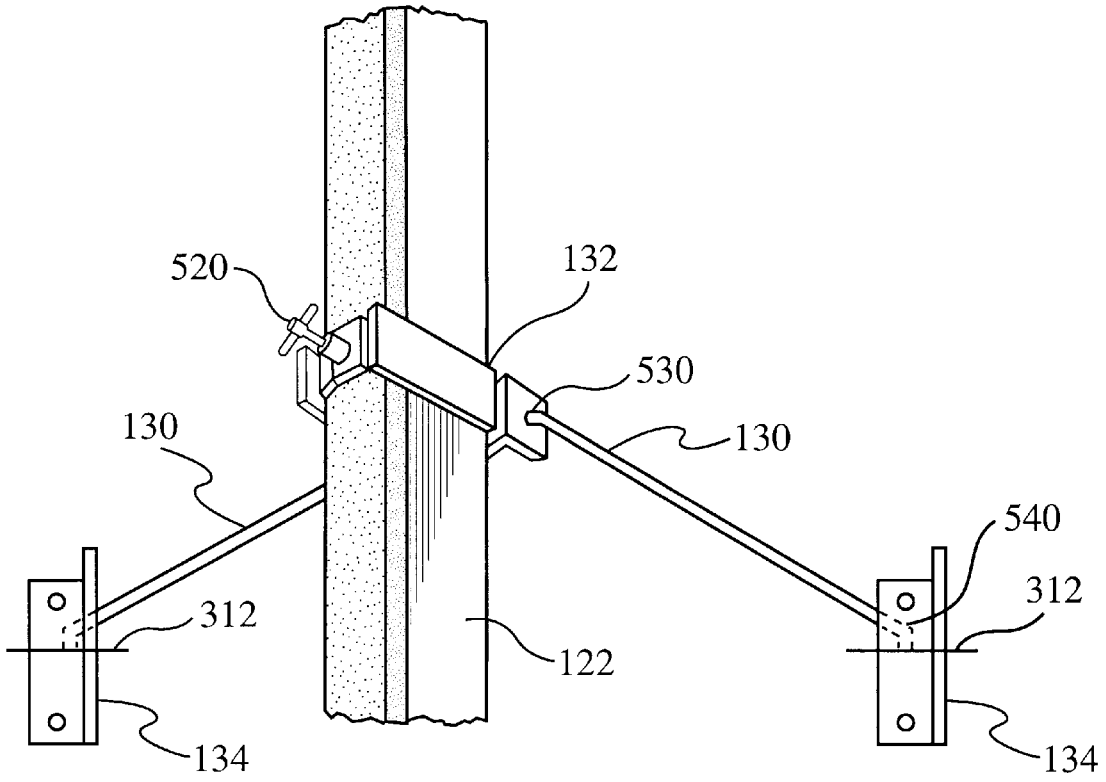
FIG. 5 is a partial perspective view of the present invention showing a bracket connector and a support bracket attached to a scaffold pole.

As shown in FIG. 5, support bracket 130 is interconnected with scaffold pole 122 through the use of bracket connector 132. Bracket connecter 132 includes a clamping mechanism 520 that clamps onto scaffold pole 122. Bracket connector 132 provides a steady base for connecting with support bracket 130. Support bracket 130 is "Λ" shaped, having one end wider than the other. The four ends of support bracket 130 are bent so as to interconnect with bracket connector 132 through a hole 530, and with bracket hold 134 through a hole 312 (see FIG. 3). A preferred embodiment of support bracket 130 and bracket connector 132 are disclosed in U.S. Pat. No. 4,446,945, the entirety of which is incorporated herein by reference.

Figure 3:
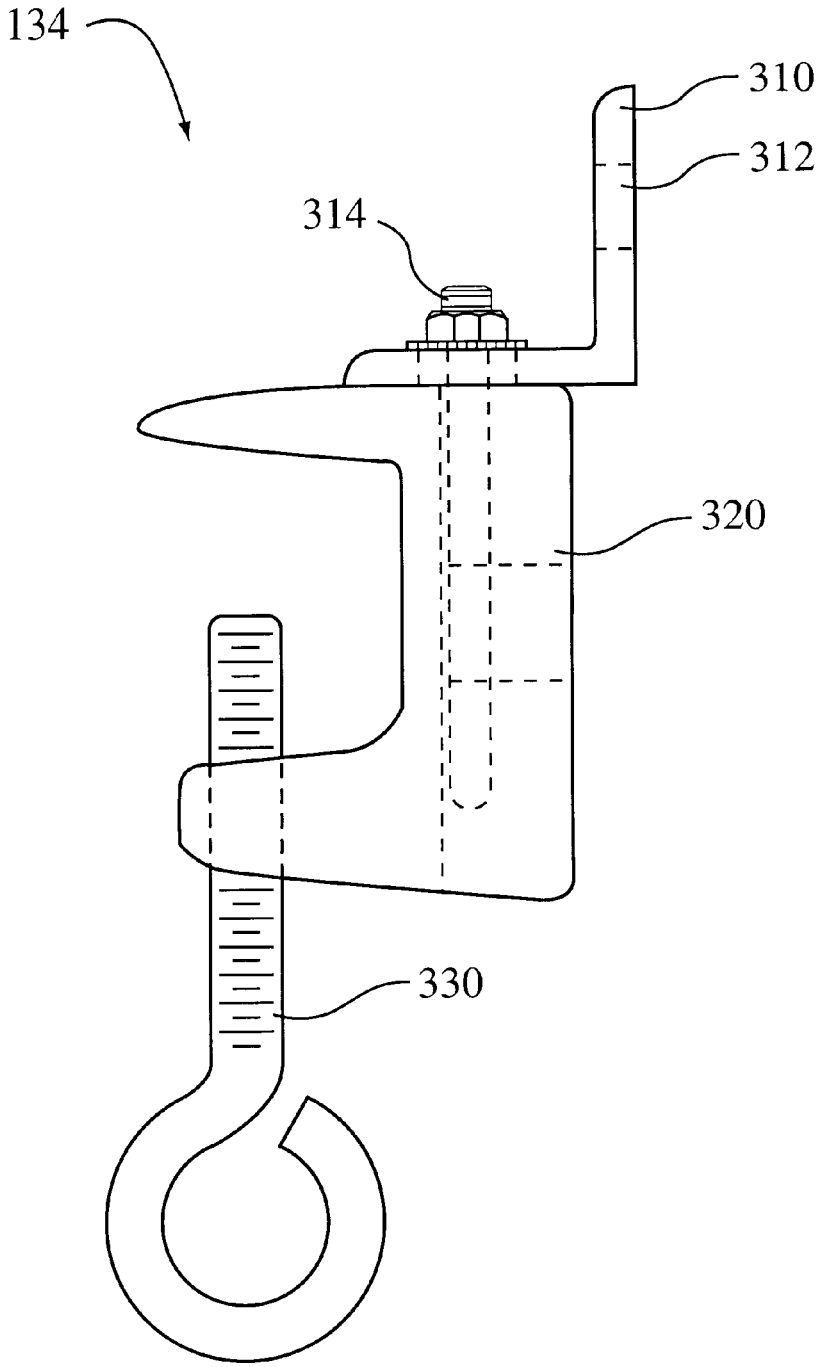
FIG. 3 is a side elevational view of an embodiment of a bracket hold, showing the use of a clamp.

FIG. 3 shows one embodiment of bracket hold 134. Bracket hold 134 provides a support bracket connecting means for connecting support bracket 130 to a support surface, such as bulkhead 112. As shown in FIG. 3, hole 312 is defined by a support 310. A bent end 540 (see FIG. 5) of support bracket 130 is inserted into hole 312. Support 310 is bolted to a clamp 320 using a bolt 314. Clamp 320 is affixed to steel support rib 118 along bulkhead 112 through the use of an eyebolt 330. By turning eyebolt 330, clamp 320 is tightened to steel support rib 118. In this manner, support bracket 130 is connected to bulkhead 112.

Figure 6:
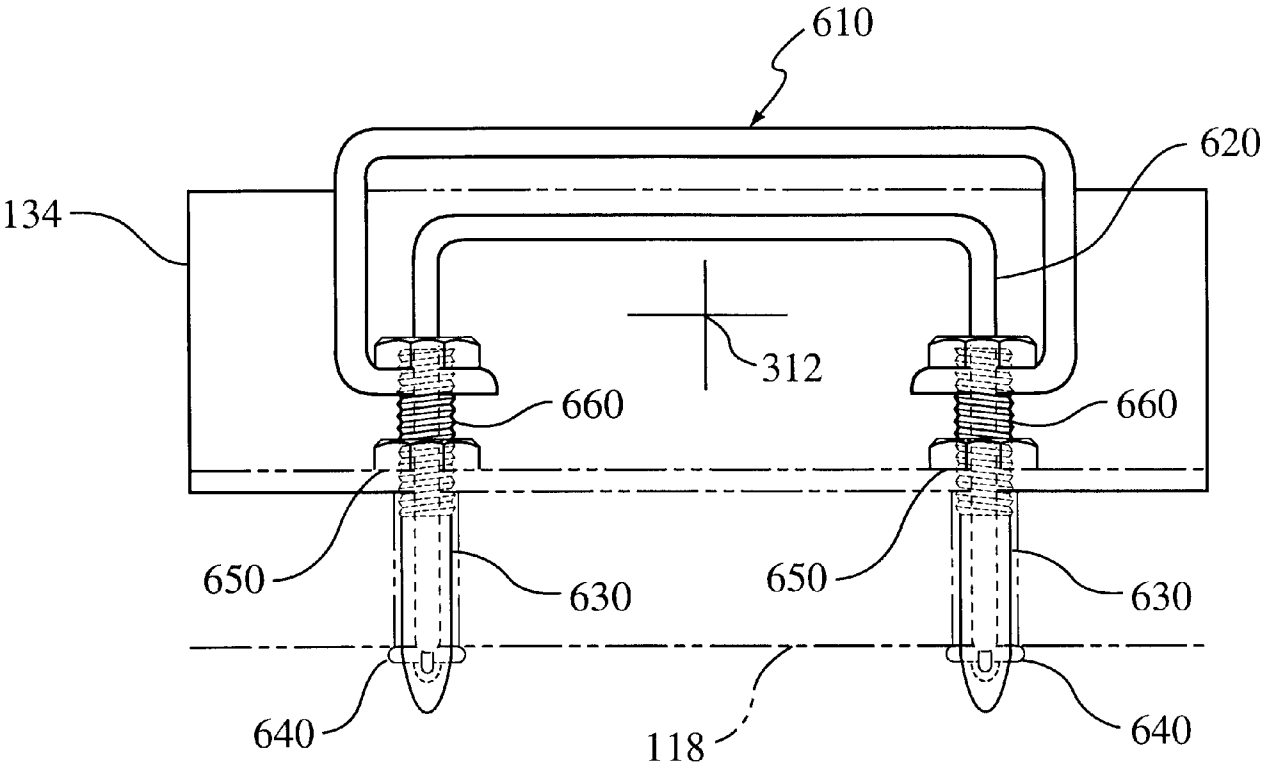
FIG. 6 illustrates a quick release trigger clamp that can be used to secure the scaffolding system to a support surface, such as a ship support rib.

In an alternative embodiment, clamp 320 and eyebolt 330 can be eliminated, and bolt 314 can be bolted directly to steel support rib 118. In yet another embodiment, clamp 320 and eyebolt 330 can be replaced by a quick release trigger clamp 610 as shown in FIG. 6. Trigger clamp 610 includes a trigger 620 connected to clamp pins 630. Adjusting nut 650 is used to adjust for thickness. Trigger clamp 610 is spring-loaded through the use of springs 660. When trigger 620 is squeezed, ball bearings 640, that protrude out from clamp pins 630, slide back into place. In this manner, clamp pins 630 can be removed as a group using only one hand.

Bracket hold 134 can be attached to any support surface using any of the foregoing embodiments, or any other type of bolting or clamping means. This allows support bracket 130 to be connected to various types of support surfaces. It is to be understood that the present invention is not limited to use with a bulkhead or support ribs as shown in the illustrated embodiment.

Figure 4:
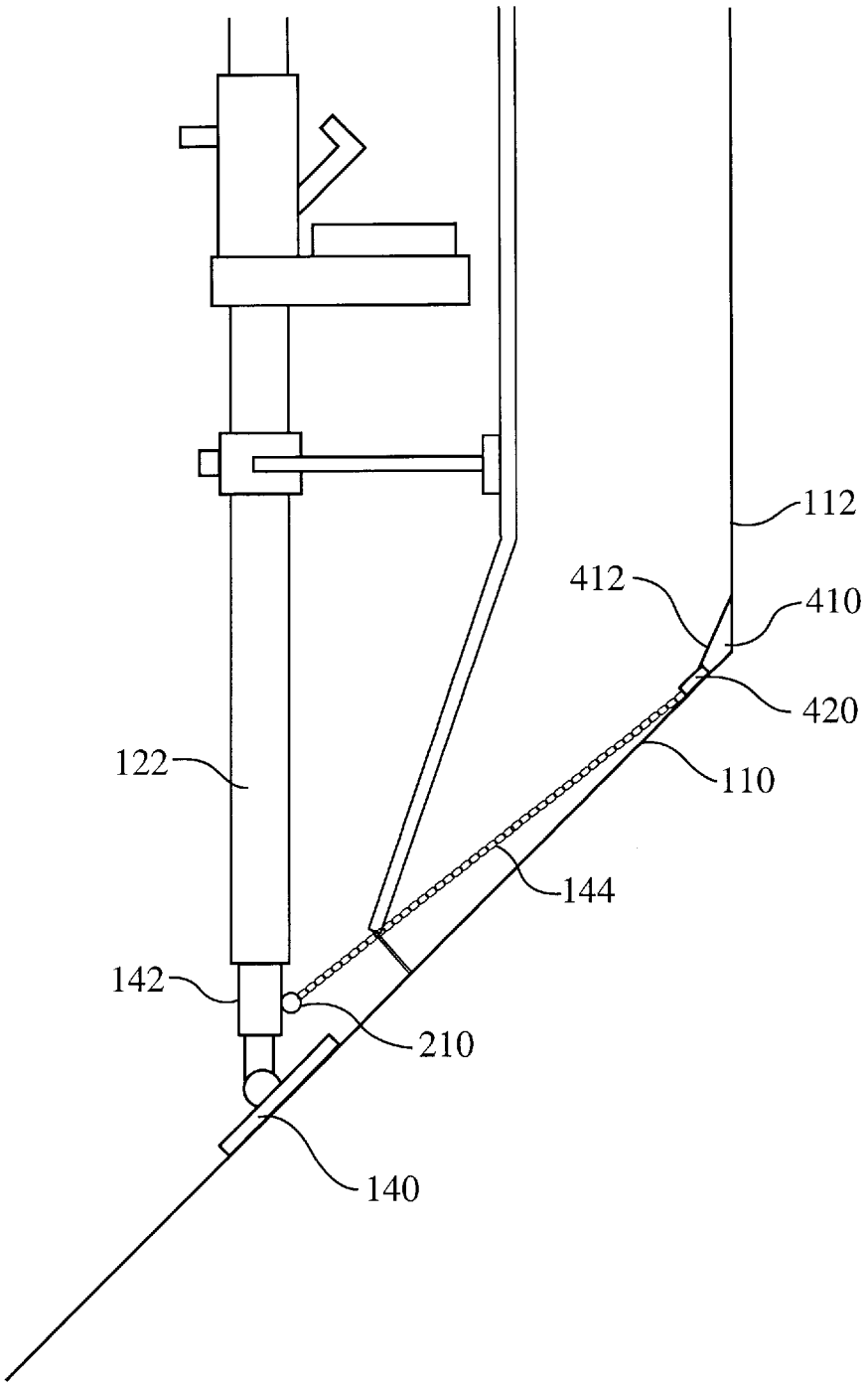
FIG. 4 is a partial elevational view of an embodiment of the present invention showing a preventer.

FIG. 4 is a partial side elevational view of the present invention, showing one embodiment of preventer 144. Preventer 144 functions as an additional lateral support for scaffold pole 122. Preventer 144 is also a preventing means for preventing scaffold pole 122, and swivel foot 140, from sliding along downsloping hopper wall 110. Preventer 144 ensures the stability of each scaffold pole 122 relative to the vertical axis, while mounted on an inclined surface. In a preferred embodiment, preventer 144 comprises a securing line that is connected to scaffold pole 122 and to the support surface, such as support rib 118 or bulkhead 112. In the illustrated embodiment, preventer 144 comprises a chain that is connected at one end to eyebolt 210. The other end of the chain is connected to a portion 412 of bulkhead 112 by use of a hook 420. Bulkhead portion 412 extends between bulkhead 112 and downsloping hopper wall 110 to define an open space or region 410 in bulkhead 112. In an alternate embodiment, the securing line of preventer 144 can be looped through open space 410 and back to eyebolt 210 so that both ends of the securing line are connected to eyebolt 210.

The securing line of preventer 144 can be formed of materials other than a chain. For example, the securing line can be configured as a nylon strap, a rayon strap, or a combination strap made from more than one material, such as nylon and rayon. Alternatively, the securing line can be configured as a "come-along", such as that used in maritime rigging.

In operation, the scaffolding system of the present invention can be easily and quickly erected in a cargo hold of a ship after the cargo has been off-loaded. This can be done while the ship is transiting to port to load the next cargo. Through the use of the scaffolding system of the present invention, the cargo hold can be cleaned in-transit, even though the cargo hold has an inclined surface and is a moving environment.

While various embodiments of the present invention have been described above, it should be understood that they have been presented by way of example, and not limitation. For example, the present invention can be used in any environment requiring use of a scaffolding system on an inclined surface, and is not limited to use in a hold of a ship. The present invention is also advantageously used in moving environments, such as in rail cars. It will be apparent to persons skilled in the relevant arts that various changes in form and detail can be made without departing from the spirit and scope of the invention. Thus, the present invention should not be limited by any of the above-described exemplary embodiments, but should be defined only in accordance with the following claims and their equivalents.

What is claimed is:

1. A scaffolding system for use on an inclined surface and with a substantially vertical support surface, comprising:

a rigid scaffold pole;

a support bracket coupled to said scaffold pole for securing said scaffold pole to the support surface;

a swivel foot coupled to said scaffold pole, said swivel foot configured to pivotally align with the inclined surface;

a bolt coupled to said scaffold pole; and preventing means for preventing said scaffold pole from sliding down the inclined surface, said preventing means including a securing line, wherein a first end of said securing line is connected to said bolt.

2. A scaffolding system as set forth in claim 1, further comprising:

a pump jack adapted to travel along said scaffold pole; and a walking plank coupled to said pump jack.

3. A scaffolding system as set forth in claim 1, further comprising:

support bracket connecting means for connecting said support bracket to the support surface.

4. A scaffolding system as set forth in claim 3, wherein said support bracket connecting means comprises a trigger clamp.

5. A scaffolding system as set forth in claim 3, wherein said support bracket connecting means comprises a clamp and an eyebolt.

6. A scaffolding system as set forth in claim 3, wherein said support bracket connecting means comprises a bolt.

7. A scaffolding system as set forth in claim 1, further comprising:

swivel foot connecting means for connecting said swivel foot to said scaffold pole.

8. A scaffolding system as set forth in claim 7, wherein said swivel foot connecting means comprises:

a first tube; and a second tube, wherein said first tube is slidably received within said second tube.

9. A scaffolding system as set forth in claim 8, wherein said first tube is round in cross-section and said second tube has a square outer surface.

10. A scaffolding system as set forth in claim 8, wherein said bolt coupled to said scaffold pole secures said first tube and said second tube to each other.

11. A scaffolding system as set forth in claim 10, wherein said bolt is an eyebolt.

12. A scaffolding system as set forth in claim 1, further comprising:

a rubber pad disposed on a bottom surface of said swivel foot so that said rubber pad contacts the inclined surface.

13. A scaffolding system as set forth in claim 1, wherein a second end of said securing line is connected to the support surface, and said securing line comprises a chain.

14. A scaffolding system for use on an inclined surface and with a substantially vertical support surface, comprising:

a rigid scaffold pole;

a support bracket coupled to said scaffold pole for securing said scaffold pole to the support surface;

a swivel foot, said swivel foot configured to pivotally align with the inclined surface;

securing means for securing said swivel foot to said scaffold pole, said securing means including a first tube, a second tube, and an eyebolt, wherein said first tube is slidably received within said second tube and said eyebolt secures said first tube and said second tube to each other; and preventing means for preventing said scaffold pole from sliding down the inclined surface, said preventing means including a securing line, wherein a first end of said securing line is connected to said eyebolt and another end of said securing line is adapted for connection to said support surface.

15. A scaffolding system as set forth in claim 14, wherein a second end of said securing line is connected to the support surface.

16. A scaffolding system as set forth in claim 14, wherein a second end of said securing line is connected to said eyebolt, said securing line looping through an open space in the support surface.

17. A scaffolding system as set forth in claim 14, wherein said securing line comprises a nylon strap.

18. A scaffolding system as set forth in claim 14, wherein said securing line comprises a chain.

19. A scaffolding system as set forth in claim 14, wherein said securing line comprises a rayon strap.

20. A scaffolding system in combination with a cargo hold of a ship having a substantially vertical bulkhead, a substantially vertical support rib and a downsloping hopper wall, said scaffolding system comprising:

a rigid scaffold pole;

a support bracket coupled to said scaffold pole securing said scaffold pole to said support rib;

a swivel foot, said swivel foot configured to pivotally align with and abut against said hopper wall;

securing means securing said swivel foot to said scaffold pole; and preventing means for preventing said scaffold pole from sliding down said hopper wall, wherein one end of said preventing means is connected to said securing means and an other end of said preventing means is connected to said support rib.

* * * * *